United States Patent [19]

Johnson et al.

[11] 3,985,516

[45] Oct. 12, 1976

[54] COAL DRYING AND PASSIVATION PROCESS

[75] Inventors: Clarence A. Johnson; William Volk, both of Princeton, N.J.

[73] Assignee: Hydrocarbon Research, Inc., Morristown, N.J.

[22] Filed: Aug. 20, 1975

[21] Appl. No.: 606,256

[52] U.S. Cl. ..... 44/1 R; 44/1 G; 44/6; 34/10

[51] Int. Cl.[2] ..... C10L 9/00; F26B 3/08

[58] Field of Search ..... 44/1 G, 1 R, 6; 201/23, 201/31; 34/10

[56] References Cited

UNITED STATES PATENTS

| | | | |
|---|---|---|---|
| 1,594,994 | 8/1926 | Bone | 44/1 R |
| 2,183,924 | 12/1939 | Schoch | 44/1 G |
| 3,414,480 | 12/1968 | Stotler et al. | 201/31 X |
| 3,565,766 | 2/1971 | Eddinger et al. | 201/31 X |

*Primary Examiner*—Carl F. Dees

[57] ABSTRACT

Low rank coals such as subbituminous or lignites containing more than about 10 wt. % moisture are first dried and then passed to a fluidized bed where the coal is passivated against reabsorption of moisture by coating the warm coal particles with a heavy liquid hydrocarbon material. Such coating substantially prevents the reabsorption of moisture in the coal, and thereby prevents autogenous heating and possible spontaneous ignition during subsequent transportation or storage of the passivated coal.

14 Claims, 2 Drawing Figures

COAL DRYING AND PASSIVATION PROCESS

BACKGROUND OF THE INVENTION

One of the major problems associated with using the low rank coals such as subbituminous or lignites as found in the Western United States is their high moisture content, usually ranging from 15 to 50 wt. %. If such coal is shipped to the consumer, there is a large weight penalty due to the negative value of the water content. Also, upon burning the coal, considerable heat is required to vaporize the high moisture content which reduces overall process efficiency.

It has been proposed that such low rank subbituminous coals or lignites be dried at the mine before shipment or use. However, it has been observed that when dried, the coal undergoes substantial reabsorption of moisture and consequential heating, which makes the coal subject to spontaneous ignition during shipment and/or subsequent storage. Furthermore, the desirability of passivating such dried coals by coating them with a heavy oil or tar material so as to substantially prevent the reabsorption of moisture has been generally recognized.

For example, the U.S. Pat. No. 1,905,513 to Stuart describes a method for filming (coating) coal with a preserving hydrocarbon film which is impervious to both air and water so as to help prevent dusting and oxidation of the coal before burning. U.S. Pat. No. 1,960,917 to Nagelvoort describes a method for removing excess moisture from wetted coal by spraying it with a dilute oil emulsion to facilitate the drainage of excess water from the coal. Also, U.S. Pat. No. 2,197,792 to Erickson describes apparibes apparatus for spraying of coal with oil or wax to prevent dusting, while Wattles — U.S. Pat. No. 2,204,781 — describes coating exposed surfaces of coal piles with a protective weather-excluding coating material. Furthermore, Lykken — U.S. Pat. Nos. 2,610,115 and 2,811,427 — describe a method for dehydrating lignite by mixing it with 3 to 10% mineral hydrocarbon at normal temperature and then heating the mixture to about 300° F in a rotating kiln to remove moisture and leave the lignite particles coated with the hydrocarbon material. Although the problem has been recognized for more than 50 years, and there are some reported laboratory scale data, there has been, to date, no practical process for accomplishing such passivation of wet coals and lignites on a commercial scale which will provide such a substantially moisture-free, stable, low rank coal.

SUMMARY OF THE INVENTION

We have discovered that moisture-containing combustible solid carbonaceous materials such as low rank subbituminous coals or lignites, containing at least 10 wt.% moisture and usually 15 to 50 wt.%, and after "sizing", can be dried in a drying zone and then passivated against substantial reabsorption of moisture by coating the dried particulate solids with a relatively small net amount of a heavy liquid hydrocarbon material in a fluidized bed. Preferably, the drying zone also comprises a fluidized bed located above the fluidized coating or passivating bed.

The freshly mined moisture-containing solid carbonaceous material is first crushed to desired size, usually less than about ½-inch and preferably ⅛- to ⅜-inch size, and is then fed into the drying zone of a processing vessel. Herein the coal is heated by a warm inert gas flowing upwardly through the coal to maintain a temperature of at least 200° F, but not sufficient to cause devolatilization of the coal. Residence time in the drying zone will vary from a few seconds to several minutes depending upon the zone configuration and temperature used. For a fluidized bed type drying zone, the coal residence time should be at least about 2 minutes and preferably 3 to 15 minutes. The pressure within the processing vessel should be essentially atmospheric, but could have a slight positive pressure such as 0.5 to 5 psig if desired for improved flow control.

After the coal has been heated and dried, it is passed downwardly to a lower coating zone which comprises a fluidized bed operating at a temperature at least 50° F higher than the drying zone temperature. A heavy liquid hydrocarbon material such as residual oil, is injected into this lower coating zone and the fluidized coal particles are coated with the liquid sufficiently to substantially prevent the reabsorption of moisture in the coal. At least about 0.1 wt.% of oil and preferably 0.2 to 1.0 wt.% of oil will be absorbed by the dried coal, but the oil coating should not exceed about 2.0 wt.%. Under some conditions, it may be desirable to dilute the heavy hydrocarbon liquid with a lighter carrier oil to adjust the viscosity of this stream and assist in the uniform coating of the particles in the fluidized bed. The passivated coal is then withdrawn from the lower fluidized bed and passed to storage preliminary to shipment to or use by the consumer.

The fluidizing and drying gas used should be relatively inert, such as containing not over about 2.0% $O_2$. It is heated by a suitable heat source before being introduced below the lower fluidized bed, and then passed upwardly through both beds or zones in series. The effluent gas containing moisture removed from the coal along with some hydrocarbon vapors is withdrawn from above the drying zone of the treating vessel and is cooled to near ambient temperature before being passed to a phase separation step to remove the condensed liquid. The remaining gas, comprising a mixture of water and hydrocarbon vapors, is then recompressed and reheated before being recycled and reintroduced into the lower fluidized bed as before, to heat and fluidize same. To achieve a greater degree of moisture removal from the coal, heating it to somewhat higher temperature such as above 250° F but below about 500° F is done.

A condensed water stream is withdrawn from the bottom of the phase separation step. The condensed oil removed from the phase separation step may be used as a part or all of the diluent for the heavy hydrocarbon coating oil.

DESCRIPTION OF THE PREFERRED EMBODIMENT

Figure 1:
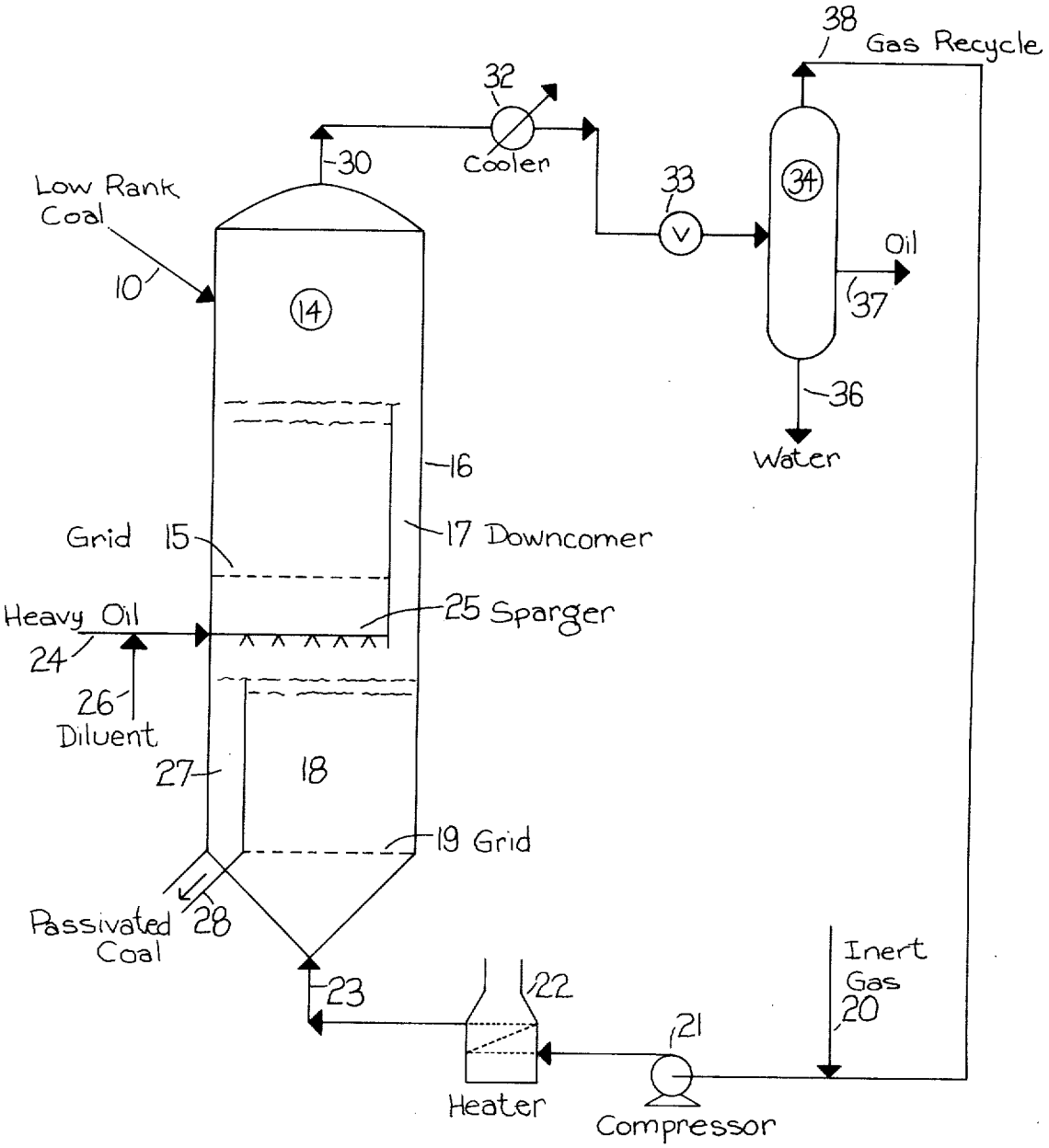
FIG. 1 is a schematic view of a low rank coal passivation process in which the coal is dried in an upper fluidized bed before being coated in a lower fluidized bed.

As illustrated in FIG. 1, raw ground low rank coal such as subbituminous or lignites at 10, containing at least about 10.0 wt.% moisture and usually 15–50 wt.% moisture, is introduced into the upper zone 14 supported by perforated plate 15 in treating vessel 16. A warm inert gas flowing upwardly through the zone substantially dries the coal to below about 3.0 wt.% moisture and preferably as low as 1.0 or 2.0 wt.% moisture. The dried coal then overflows the downcomer 17 and falls into the subadjacent fluidized bed 18 supported by perforated plate 19.

An inert fluidizing gas at 20 such as nitrogen, $CO_2$, or flue gas is compressed at 21 and heated by a heater 22 to at least 250° F and preferably above 400° F. The heated gas passes upwardly through lower bed 18 not only to heat the bed, but at a velocity to also fluidize the bed.

In this zone, below the grid 15, a heavy liquid hydrocarbon material is provided at 24 and injected over the fluidized bed 18 by sparger means 25. The warm dry coal is uniformly coated with the heavy hydrocarbon liquid in the fluidized bed 18, which is maintained at 250° to 500° F temperature and 0–5 psig pressure. The heavy hydrocarbon oil may be diluted with a lighter oil 26 to reduce its viscosity. This diluent oil is then vaporized in the fluid bed. The passivated coal overflows into downcomer 27 and is withdrawn from the treating vessel at 28.

The effluent gas carrying moisture removed from the coal along with some hydrocarbon vapor is withdrawn from the upper end of the treating vessel 16 as stream 30, and is cooled at 32 to near ambient temperature and, after pressure reduction at 33, is passed to phase separator 34. The condensed water portion is removed as stream 36 and a light condensed oil stream is removed at 37. The remaining gas is removed overhead as stream 38, and is returned to compressor 21 for recirculation as the fluidizing and heating gas.

Figure 2:
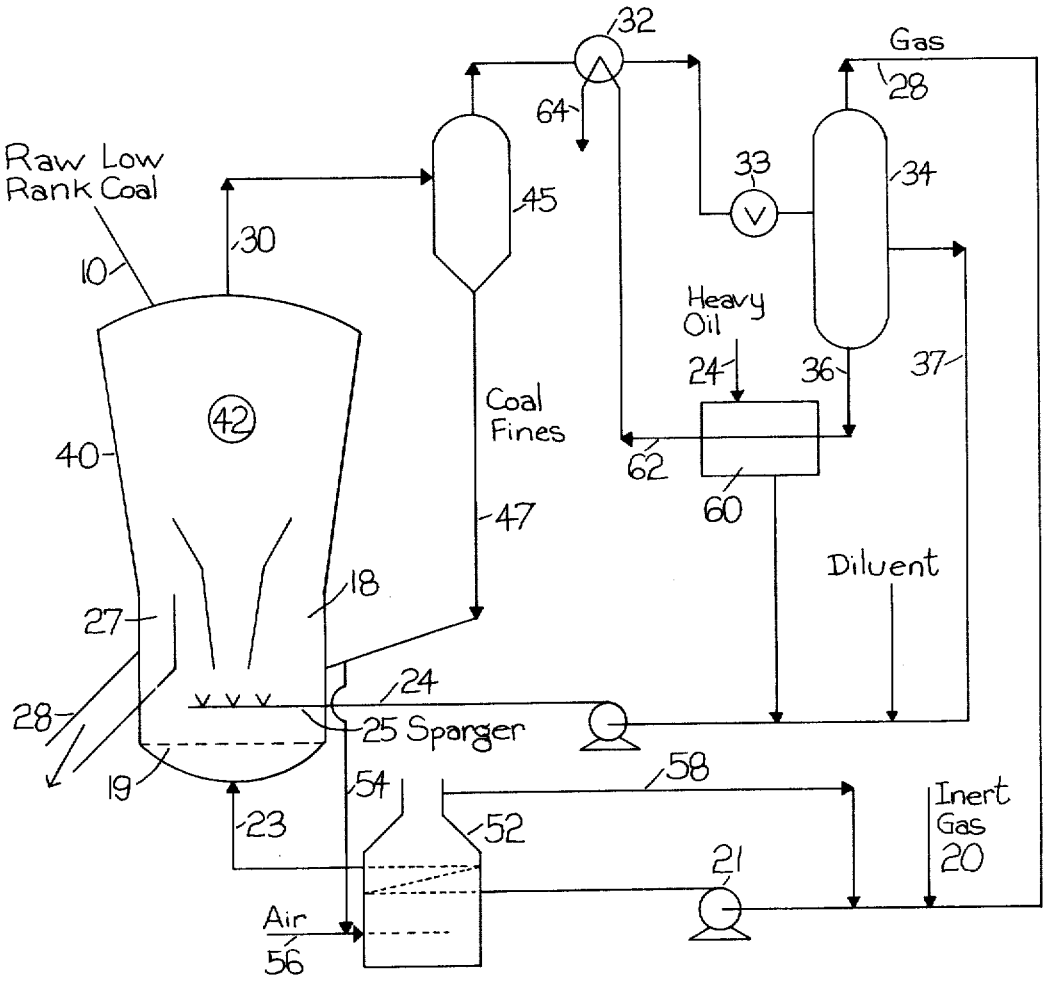
FIG. 2 is a schematic view of a modified form of a low rank coal passivation process utilizing separate zones for drying and coating the coal.

FIG. 2 shows certain improvements to the FIG. 1 embodiment. In this figure, the same item numbers are used for the apparatus which is functionally similar to the apparatus of FIG. 1. Coal or lignite fines which may contain at least 10 wt.% moisture and usually 15 to 50 wt.% are introduced into treating vessel 40 through conduit 10 into upper free-fall drying zone 42 against the upflow of an inert drying and fluidizing gas entering at 23 below the lower grid or perforated plate 19. This gas at a temperature of above 200° F, but below a coal devolatilization temperature, and preferably not above 500° F, will dry the coal to as low as 1.0 to 2.0 wt.% moisture. The effluent gas at 30, in this form of embodiment, passes first to a gas-solids separator 45 from which the fines can be returned by conduit 47 to the lower part of the vessel 40 into a zone carrying the lower fluidized bed 18.

As in the prior form of embodiment of the invention, the lower bed of coal is coated with a heavy liquid hydrocarbon oil entering in line 24 and distributed by sparger 25. This lower bed is maintained at a temperature at least 50° F higher than the upper free-fall bed 42 and preferably at 250° to 500° F. Pressure is from 0 to 5 psig. The coated and passivated coal overflows into the downcomer 27 from which it is withdrawn at 28. A baffle member 50 of generally conical nature, tends to shield the upper part of downcomer 27 from direct flow of uncoated coal. Also for this embodiment, the compressed fluidizing gas entering at 23 is heated by a combustion type heater 52, which is fired with coal such as a portion 54 of the dried coal fines removed at 47. Combustion air is supplied at 56. A portion of the resulting flue gas is withdrawn as stream 58 and utilized as a makeup fluidizing gas stream.

If desired, a light distillate oil at 26 can be mixed with the heavy liquid hydrocarbon stream 24 as a carrier oil to adjust the composition and viscosity of this heavy liquid stream, so as to assist in the uniform coating of the coal particulates in the fluidized bed. A light condensed oil stream 37 can also be removed from separator 34, and can preferably comprise a major portion of the solvent carrier or diluent oil stream 26 which is recirculated by pump 39. Although sufficient heavy hydrocarbon liquid should be introduced at 24 to coat the particulate material with at least about 0.1 wt.% oil and not to exceed about 2.0 wt.% oil, improved passivation results may be obtained by preferably adding between about 0.2–1.0 wt.% oil.

As a further improvement in FIG. 2, the condensed water stream 36 which is recovered from phase separator 34 at above ambient temperature can be utilized to preheat the heavy liquid hydrocarbon stream 24 in heat exchanger 60. The resulting cooled water stream 62 can then be further utilized as a portion of the cooling fluid in cooler 32, before being discarded at 64.

Having generally described our invention, it will be apparent that equivalent embodiments may be used and that certain features may be used without other features all within the spirit and scope of the invention and as defined only by the appended claims.

We claim:

1. A process for passivating particulate pyrophoric low rank coals containing at least 10% moisture by weight, in a vessel containing a drying zone and a subadjacent coating zone, comprising the steps of:

a. passing an inert gas upwardly through the coating zone and drying zone of the treating vessel, at a temperature sufficiently high to vaporize the moisture in the carbonaceous material but below the temperature at which the carbonaceous material will devolatilize, and at sufficient velocity to maintain the carbonaceous material in a fluidized condition in the coating zone;

b. feeding the particulate material to the drying zone of the treating vessel;

c. maintaining the particulate material in the drying zone for a period of between 2 and 15 minutes whereby the material is dried to less than about 5% by weight of moisture by the hot gas flowing from the coating zone to the drying zone;

d. passing the dried material to the particle coating zone;

e. introducing a heavy hydrocarbon liquid into the particle coating zone, whereby the dried material is substantially uniformly coated with between 0.5 and 5.0 wt.% hydrocarbon;

f. withdrawing a warm moisture containing gas from the upper portion of the drying zone;

g. withdrawing the coated material from the coating zone.

2. The process of claim 1 wherein the effluent gas from the upper part of the drying zone is cooled, phase separated to remove the liquid portion, and the inert gas remaining is reheated and recirculated to the coating and drying steps.

3. The process of claim 1 wherein the temperature of particulate material in the drying zone is at least 200° F and below 500° F and the heating gas pressure is not above 10 psig pressure.

4. The process of claim 1 wherein the drying zone comprises a fluidized bed of solid particulate material in which the average residence time is at least 2 minutes.

5. The process of claim 1 wherein the warm gas stream withdrawn from the upper end of the drying zone is passed through a gas-solids separation step, and at least a portion of the particulate fines removed therein are returned to the second fluidized coating bed.

6. The process of claim 1 wherein the fluidized bed coating zone operates at a temperature at least 50° F higher than the drying zone temperature.

7. The process of claim 1 wherein the heavy liquid hydrocarbon coating material is introduced onto the upper portion of the fluidized bed of dried particulate material.

8. The process of claim 1 wherein the pyrophoric coal is crushed to particle size smaller than ½-inch.

9. The process of claim 1 wherein a light condensed oil stream is withdrawn from the phase separation step and at least a portion is mixed with the heavy liquid hydrocarbon coating material as a carrier oil before the liquid mixture is introduced into the second coating zone.

10. The process of claim 2 wherein the inert fluidizing gas is heated by a combustion heater fired by a portion of the dried carbonaceous fine material and a portion of the flue gas produced thereby is used as make-up for the fluidizing and heating gas passed upwardly through the beds.

11. The process of claim 2 wherein the water removed from the phase separation step is used to preheat the heavy hydrocarbon liquid introduced into the lower fluidized bed.

12. The process of claim 1 wherein the drying zone is above the oil coating zone.

13. The process of claim 12 wherein the drying zone is a free-fall zone.

14. The process of claim 1 wherein the pyrophoric carbonaceous material is sized to between ⅛-inch and ⅜-inch, the pressure of the inert gas is 0.5 to 5.0 psig, the drying period is from 3 to 15 minutes, and the temperature is 200° to 400° F, the heavy hydrocarbon oil is sprayed on the dried carbonaceous material at a temperature between 400° and 500° F, and the passivated material is removed with from 1.0 to 2.0 percent of oil coating and less than 2.0 weight percent moisture.

* * * * *